US010422099B2

(12) United States Patent
Whiteley

(10) Patent No.: US 10,422,099 B2
(45) Date of Patent: Sep. 24, 2019

(54) COVER AND METHOD OF MANUFACTURE THEREOF

(71) Applicant: OXFORD PLASTIC SYSTEMS LIMITED, Oxfordshire (GB)

(72) Inventor: Christopher James Whiteley, Oxfordshire (GB)

(73) Assignee: Oxford Plastic Systems, Ltd., Enstone, Oxfordshire (GB)

( * ) Notice: Subject to any disclaimer, the term of this patent is extended or adjusted under 35 U.S.C. 154(b) by 0 days.

(21) Appl. No.: 15/787,375

(22) PCT Filed: Apr. 21, 2016

(86) PCT No.: PCT/GB2016/051111

§ 371 (c)(1),
(2) Date: Oct. 18, 2017

(87) PCT Pub. No.: WO2016/170344

PCT Pub. Date: Oct. 27, 2016

(65) Prior Publication Data

US 2018/0155895 A1 Jun. 7, 2018

(30) Foreign Application Priority Data

Apr. 24, 2015 (GB) ..... 1506995.8
Sep. 28, 2015 (GB) ..... 1517119.2

(51) Int. Cl.
*E01C 5/20* (2006.01)
*E02D 17/10* (2006.01)
(Continued)

(52) U.S. Cl.
CPC ..... *E02D 17/10* (2013.01); *E01C 5/20* (2013.01); *E01C 9/086* (2013.01); *E01C 11/222* (2013.01); *E01C 15/00* (2013.01)

(58) Field of Classification Search
CPC . E02D 17/10; E01C 5/20; E01C 9/086; E01C 11/222; E01C 15/00
(Continued)

(56) References Cited

U.S. PATENT DOCUMENTS 4,572,702 A * 2/1986 Bone ..... E01D 19/06 14/73.5
5,375,386 A * 12/1994 Goad ..... E01C 11/106 404/69
(Continued)

FOREIGN PATENT DOCUMENTS

EP 3 034 694 A1 6/2016
GB 2 374 879 A 10/2002
(Continued)

OTHER PUBLICATIONS

Search Report in G.B. Patent Application No. 1506995.8, dated Aug. 24, 2015.
(Continued)

*Primary Examiner* — Raymond W Addie
(74) *Attorney, Agent, or Firm* — Potter Anderson and Corroon, LLP

(57) ABSTRACT

A cover comprises a load bearing panel (12) of generally square or rectangular form and having an upper surface (14*a*) and an underside surface (14*b*), at least some of the edges of load bearing panel (12) being provided with ramp members (22) which are molded onto the load bearing panel (12), the ramp members (22) each defining an upper ramped surface (22*a*) and a lower, ground engaging surface (22*b*), wherein the ground engaging surface (22*b*) is spaced beneath the underside surface (14*b*) of the load bearing panel (12).

11 Claims, 3 Drawing Sheets

(51) Int. Cl.

| | |
|---|---|
| ***E01C 9/08*** | (2006.01) |
| ***E01C 11/22*** | (2006.01) |
| ***E01C 15/00*** | (2006.01) |

(58) Field of Classification Search
USPC ..... 404/34–36, 72, 75
See application file for complete search history.

(56) References Cited

U.S. PATENT DOCUMENTS

| | | | | |
|---|---|---|---|---|
| 6,422,784 | B1 | 7/2002 | Pellegrino et al. | |
| 6,505,444 | B1 | 1/2003 | Johnson | |
| 6,511,257 | B1 * | 1/2003 | Seaux | E01C 9/086 404/34 |
| 6,712,546 | B1 * | 3/2004 | Radu, Jr. | B28B 7/0014 404/8 |
| 8,336,146 | B1 * | 12/2012 | Berbash | H05B 3/34 14/69.5 |
| 9,181,697 | B2 * | 11/2015 | Masanek, Jr. | E04C 2/20 |
| 2002/0184718 | A1 | 12/2002 | Armfield et al. | |
| 2008/0007011 | A1 * | 1/2008 | Buermann | F16J 15/104 277/502 |
| 2015/0110554 | A1 * | 4/2015 | Mettler | E01F 9/529 404/15 |

FOREIGN PATENT DOCUMENTS

| | | | |
|---|---|---|---|
| GB | 2 466 366 | A | 6/2010 |
| JP | H08-246407 | A | 9/1996 |
| JP | 2004-211343 | A | 7/2004 |

OTHER PUBLICATIONS

Search Report in G.B. Patent Application No. 1606972.6, dated Jun. 7, 2016.
Examination Report in G.B. Patent Application No. 1606972.6, dated Aug. 4, 2017.
Examination Report in G.B. Patent Application No. 1606972.6, dated Oct. 11, 2017.
International Search Report and Written Opinion in PCT/GB2016/051111, dated Sep. 15, 2016.

* cited by examiner

COVER AND METHOD OF MANUFACTURE THEREOF

This invention relates to a load supporting panel. In particular the invention relates to a load supporting panel in the form of a cover suitable for use in covering openings, trenches or the like formed in footpath surfaces or the like. It may be used in other applications, for example in providing a relatively smooth walkway over uneven ground surfaces, or may be used to allow pedestrians to pass over trenches or the like formed in road surfaces. Indeed, the invention may also be applicable to arrangements intended to bear the weight of vehicles, allowing vehicles to pass over trenches or the like form in road surfaces.

Load supporting panels in the form of covers are often used where trenches or cavities are formed in footpaths or road surfaces, to allow pedestrians or vehicles to continue to use the footpath or road surface.

Covers typically used in the above described applications take a range of forms. For example, metallic material sheets may be used, the sheets extending over the trench, cavity or the like. However, such arrangements suffer from a couple of significant disadvantages. Firstly, the sheets may be of a relatively thick material and so may form a significant trip hazard to pedestrians. Secondly, there is a risk that the sheet may slide or slip over the surface upon which it is supported, and this may lead to the cover being inadequately supported with the attendant risk that it may be unable to safely bear the weight of pedestrians. Additionally, the passage of pedestrians over such a cover may result in the generation of significant noise.

A number of other forms of cover are known, for example of moulded plastics material form. Whilst these covers may be shaped to include ramps or the like adjacent the edges thereof, which may reduce the formation of a trip hazard, and may be of lighter weight that a metallic sheet, and so be easier to handle, the risk of slipping or sliding of the cover still remains, and steps must be taken to avoid this. By way of example, retaining pins may be driven through openings formed in the cover and into the supporting ground surface. However, such actions may result in additional damage to the ground surface requiring subsequent remedial repair, and the additional work to secure the cover in position may be omitted with the result that the cover may slip or slide as mentioned above.

In addition, where a footpath is obstructed or closed, it is known to divert the footpath along the edge of, for example, an adjacent road surface, using appropriate barriers to demarcate the diverted footpath. As, often, the footpath adjacent a road surface is at a raised level compared to the road surface, such diversion of a footpath introduces a step into the path as the user steps up or down over the kerb between the footpath and the road surface, which may impede those with limited mobility or impaired vision, or may present a challenge to pedestrians pushing pushchairs or the like. In such circumstances, it is known to provide a load supporting panel in the form of a ramp to reduce the impact of the presence of the step, aiding the passage of users between the level of the road surface and that of the footpath.

Where load supporting panels are used, there is a risk that over time the panels may move relative to the underlying ground surface. Such movement may result in the panel being inappropriately supported, and ultimately may result in the panel being unstable and unable to safely bear the weight of, for example, a pedestrian passing over the panel.

Obviously, under such circumstances there is a risk of injury to pedestrians, or others in the vicinity of the panel.

In order to aid handling and transportation, load supporting panels used in such applications are conveniently of relatively low weight. Traditionally, steel panels or the like have been used for this purpose, but increasingly moulded plastics material panels have been used. However, in order to achieve the required weight bearing capacity, it has typically been necessary to incorporate metallic reinforcing members within the panels, adding to the weight thereof.

It is an object of the invention to provide a load supporting panel in which at least some of the disadvantages associated with known arrangements are overcome or are of reduced impact.

According to one aspect of the invention there is provided a load supporting panel comprising a load bearing main body having an upper surface and a periphery, and a flexible lip extending alongside at least part of the periphery, wherein the flexible lip is of ramped form, aiding the passage users onto the upper surface of the main body.

The load supporting panel may be of, for example, generally square or rectangular form.

Conveniently, the flexible lip extends around the full periphery of the main body. Alternatively, the flexible lip may extend adjacent, for example, two opposing sides of the main body. The flexible lip is preferably secured to the main body along its length.

The flexible lip preferably includes a ground surface engaging underside surface.

The flexible lip is preferably defined by one or more ramp members. At least part of the ground engaging surface is preferably spaced beneath the underside surface of the load bearing panel. The ramp members are preferably of a flexible plastics material. Conveniently the material of the ramp members is of relatively high density. By using a relatively high density material, it will be appreciated that the ramp members add significant weight to the cover. The use of a flexible plastics material for the ramp members allows the ramp members to flex to grip the underlying ground surface, in use. As a result, slipping or sliding of the cover over the underlying ground surface is reduced. Consequently, there is no requirement for fixing pins or the like to be used to secure the cover in position in many applications (although such fixings may still be used if desired). The generation of noise as pedestrians pass over the cover may also be reduced.

Such an arrangement is advantageous in that the flexible lip can flex to accommodate variations in the shape of the ground surface, enhancing the stability of the load supporting panel, in use. The material of the flexible lip is preferably selected to be such that sliding movement of the load supporting panel over the ground surface, in use, is avoided or reduced.

The spacing of the ground engaging surface beneath the underside surface of the load bearing panel ensures that, in use, it is the ground engaging surfaces of the ramp members, rather than the underside of the load bearing panel, that directly engages the underlying ground surface, thereby ensuring that the reduction in the risk of slipping or sliding is achieved.

The flexible lip is conveniently moulded onto the main body. Conveniently, the ramp members are overmoulded onto the edges of the load bearing panel. The use of such a technique avoids the need to provide other fixings to secure the ramp members in position. Alternatively, it may be manufactured as a separate component, for example for subsequent bolting or other attachment thereto.

Preferably, the panel includes a projecting flange provided with openings through which the overmoulded ramp material extends, in use. As a result, the ramp members are firmly secured along their length to the panel. Alternatively, the flange may be provided with other interlocking features such as saw tooth type formations.

Another option may be for the panel to define a recess shaped to define interlocking features with which the overmoulded ramp material cooperates to firmly secure the ramp members to the panel along their length.

In a further alternative, the panel may be of two part form, the parts being arranged to be secured to one another whilst clamping part of the ramp member therebetween to secure the ramp member to the panel along its length.

It will be appreciated that by ensuring that the ramp members are secured along their length, either continuously or at intervals there along, to the panel, the risk of separation of the ramp members from the panel, which could lead to the formation of a trip hazard, is reduced.

Where the cover includes ramp members adjacent all four edges thereof, the ramp members may conveniently be formed in a single moulding operation, the ramp members being formed integrally with one another as a single element.

The material of the flexible lip is preferably of tougher form than that of the main body, being capable of withstanding mistreatment and impacts without suffering significant damage.

The upper surface of the load bearing panel may be provided with an anti-slip surface texture or the like. The load bearing panel may be of a brightly coloured material so as to make it clearly visible.

The load supporting panel may take the form of a cover intended to be positioned over a trench or cavity formed in a footpath or road surface. Alternatively, the load supporting panel may take the form of a ramp intended to aid the passage of pedestrians between a raised footpath and a lower road surface level.

According to another aspect of the invention there is provided a method of manufacture of a cover of the type described hereinbefore, the method comprising the steps of moulding a load bearing panel of generally square or rectangular form and having an upper surface and an underside surface, and overmoulding ramp members onto at least some of the edges of load bearing panel, the ramp members each defining an upper ramped surface and a lower, ground engaging surface, wherein the ground engaging surface is spaced beneath the underside surface of the load bearing panel.

The ramp members may interengage with the panel using any of the techniques described hereinbefore.

According to another aspect of the invention there is provided a cover for covering a trench, cavity, opening or the like formed in a ground surface, the cover comprising a panel provided with at least one vent opening. The provision of the vent opening may allow gas to escape from the trench, cavity, opening or the like, avoiding the formation of a dangerous build-up of gas in the trench, cavity, opening or the like. The panel may further be provided with a closable opening adapted to allow the passage of a gas probe to allow gas measurements to be made.

According to another aspect of the invention there is provided a load supporting panel comprising a main body of plastics material form, the main body including an upper surface, at least one elongate channel or pocket being formed within the main body, the elongate channel or pocket extending substantially parallel to the upper surface, and an elongate reinforcing member located within the channel or pocket, having been introduced into the channel or pocket after the manufacture of the main body.

The elongate reinforcing member is conveniently of hollow form, thereby allowing weight savings to be made. Whilst it could be of, for example, tubular steel form, the elongate reinforcing member is conveniently of plastics material form. By way of example, it may be of extruded or pultruded form.

A plurality of reinforcing members may be provided, for example arranged parallel to one another or forming a grid or the like.

The reinforcing member is conveniently slid, axially, into the channel or pocket, and the shape of the channel or pocket is conveniently such as to retain the reinforcing member in position. However, arrangements are also possible in which the reinforcing member is introduced in a different direction and/or is retained in position using an alternative technique such as by being bolted in position or by using an appropriate adhesive.

The main body is conveniently of moulded plastics material form, being moulded in such a manner as to form the elongate channel or pocket. By way of example, it may be of injection moulded or blow moulded form. Alternatively, the main body may be constructed from two or more parts which interact to define the elongate channel or pocket.

The main body conveniently defines a periphery, a flexible lip being provided and extending alongside at least part of the periphery, wherein the flexible lip is of ramped form, aiding the passage of users onto the upper surface of the main body. The manner in which the flexible lip is provided may serve to secure the elongate reinforcing member in position, preventing removal of the elongate reinforcing member from the channel or pocket. The lip may be of the type outlined hereinbefore.

The invention will further be described, by way of example, with reference to the accompanying drawings, in which.

Figure 1:
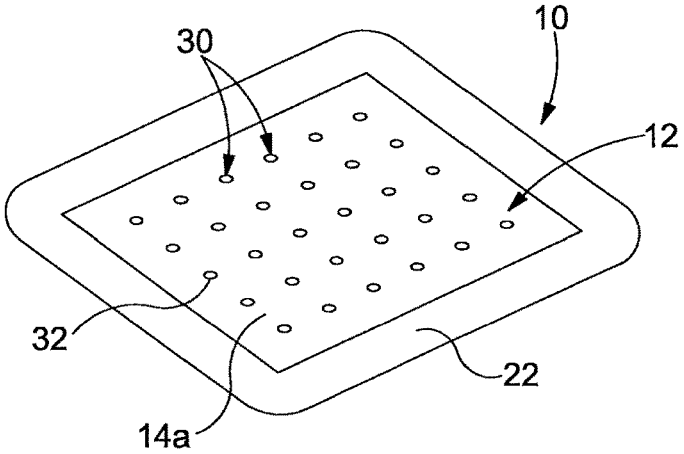
FIG. 1 is a view illustrating a load supporting panel in accordance with an embodiment of the invention.
Figure 2:
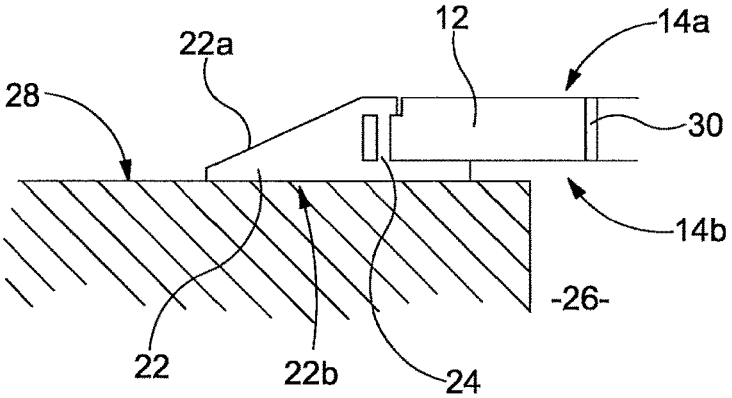
FIG. 2 is a diagrammatic sectional view illustrating part of the panel.
Figure 3:
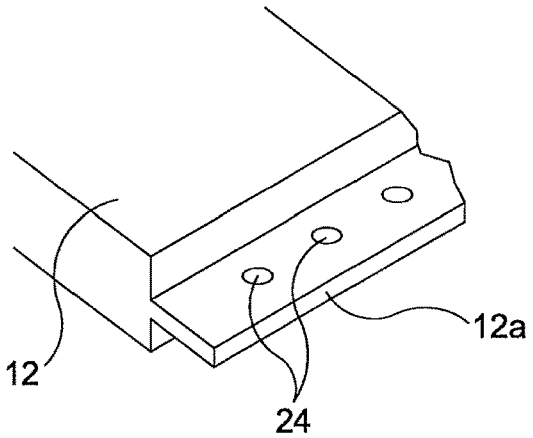
FIG. 3 is another diagrammatic sectional view.

Referring to FIGS. 1 to 3 of the accompanying drawings, a cover 10 in accordance with an embodiment of the invention is illustrated. The cover 10 of this embodiment is intended for use as a cover to be positioned, in use, over a trench or cavity formed in a footpath to allow the continued use of the footpath by pedestrians in a safe manner despite the presence of the trench or cavity therein. Whilst this embodiment of the invention is intended for use in covering a trench or cavity formed in a footpath, it will be appreciated that, if desired, the cover 10 may be modified to allow use thereof on a road surface, the cover 10 being modified to allow it to safely carry the weight of a passing vehicle or the like. Furthermore, the cover 10 may be used or adapted to be used in a range of other applications.

As shown in FIGS. 1 and 2, the cover 10 comprises a load support panel 12 of moulded plastics material form. Preferably, the panel 12 is of reinforced form, for example incorporating steel reinforcing rods or being of glass fibre reinforced form. The panel is of generally square or rectangular form, defining pairs of parallel or generally parallel edges. The panel 12 includes an upper surface 14*a* which is conveniently provided with an anti-slip surface coating or surface texture, and a lower or underside surface 14*b*. The panel 12 is conveniently moulded from a brightly coloured or high visibility plastics material so that the presence of the panel 10 will be clearly visible, in use, to pedestrians using the footpath.

The load supporting panel 10 further comprises a series of flexible ramp members 22, each of which extends adjacent a respective edge of the panel 12. In the arrangement illustrated, ramp members 22 are provided adjacent all four edges of the panel 12, and the ramp members 22 are conveniently formed simultaneously, and are formed integrally with one another to form a single element that extends about substantially the full periphery of the panel 12. However, this need not always be the case, and arrangements are possible in which separate ramp members 22 are provided. In the arrangement illustrated, therefore, in which the panel 12 is of generally square or rectangular form, there are four ramp members 22 integrally interconnected with one another at the corners of the panel.

As shown in FIGS. 2 and 3, a series of spaced openings 24 are formed in a flange 12*a* projecting from the main part of the panel 12 at the edges thereof. The ramp members 22 are formed by being overmoulded onto the panel 12. During the moulding of the ramp members 22, therefore, some of the material forming the ramp members 22 will flow into the openings 24, thereby securing the ramp members 22 to the main body 12 along the length of the ramp members 22.

It will be understood that the method by which the cover 10 is manufactured includes the steps of moulding a load bearing panel 12, providing the panel 12 with the aforementioned openings 24, placing the panel 12 into a suitable mould and overmoulding the ramp members 22 onto the edges of the panel 12, conveniently overmoulding all of the ramp members 22 in a single operation.

The ramp members 22 are arranged such that, in use, as shown in FIG. 2, when the cover 10 is positioned over a trench or cavity 26, a lower, ground engaging surface 22*b* of each of the ramp members 22 bears against the ground surface 28 adjacent the trench of cavity 26. The material of the ramp members 22 is more flexible than that of the panel 12, and flexes, in use, to accommodate variations in the underlying ground surface 28 to ensure that the cover 10 is stably supported. The material of the ramp members 22 is conveniently of a type that resists sliding movement of the cover 10 relative to the underlying ground surface 28. Preferably, the shape of the ramp members 22 is such that they extend, partially, beneath of the edges of the panel 12, with the result that it is the ground engaging surfaces 22*b* of the ramp members 22 rather than the underside surface 14*b* of the panel 12, primarily, that bears against the underlying ground surface 28.

The ramp members 22 are of ramped form, defining an upper ramped surface 22*a*, thereby aiding the movement of pedestrians onto the cover 10, reducing the size of the trip hazard presented by the presence of the cover 10. Conveniently, the material of the ramp members 22 is relatively robust, being capable of withstanding impacts and other forms of mistreatment that may occur in use with minimal damage occurring thereto. By way of example, the ramp members 22 may be manufactured from a recycled plastics material if desired.

In some circumstances, it may be desirable to increase the weight of the cover 10, for example to increase security and reduce the likelihood of sliding or displacement thereof if knocked. One way in which this may be achieved in a cost effective manner is to use a relatively dense material, such as the aforementioned recycled flexible plastics material.

Where the cover 10 is to be used in covering a relatively long trench or the like, with two or more such cover 10 being positioned adjacent one another, then it may be preferred to provide a mechanism whereby two or more of the covers 10 can be connected to one another to prevent separation of the covers 10, in use.

As shown in FIG. 1, the panel 12 is preferably formed with a series of vent openings 30 arranged to allow gas to escape from the trench 26, reducing the risk of the formation of a dangerous build-up of gas within the trench 26. The panel 12 is further formed with a larger opening closed by a plug 32 and through which a sensor probe may be introduced, in use, in order to allow measurements to be made of gas concentration within the trench 26.

It will be appreciated that the arrangement described hereinbefore is advantageous in that a cover is provided of a form that reduces the formation of trip hazards, and is designed to be of enhanced stability, in use, reducing slipping or sliding movement of the panel and reducing noise which could be generated were a panel to be unstably positioned over a trench.

Figure 4:
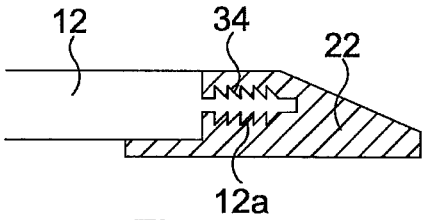
FIGS. 4 to 6 are views illustrating alternative embodiments.
Figure 5:
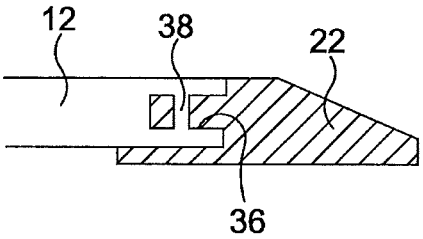

Whilst FIGS. 1 to 3 illustrate a cover 10 in which overmoulded ramp members 22 are secured, along their length to the panel 12 by part of the ramp material extending through openings 24 formed in the panel 12, other techniques are possible for firmly securing the ramp members 22 along their length to the panel 12. By way of example, FIG. 4 illustrates an arrangement in which the flange 12*a* is formed with saw-tooth formations 34 with which the material of the ramp member 22 interengages to form a mechanical lock between the ramp member 22 and the panel 12 after overmoulding of the ramp member 22 to the panel 12. FIG. 5 illustrates an alternative in which the overmoulded ramp material extends into a recess 36 formed in the panel 12, the recess 36 being provided with formations, in this case in the form of columns 38, around or with which the ramp material extends to secure the ramp member 22 to the panel 12.

Figure 6:
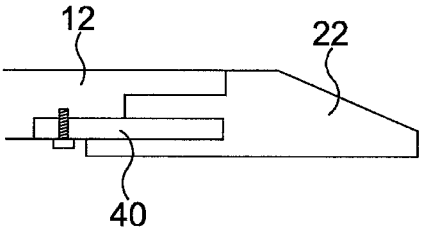

FIG. 6 illustrates an arrangement in which the panel 12 includes a clamp member 40 arranged to be secured thereto, for example by being bolted thereto, the panel 12 and clamp member 40 clamping a part of a moulded ramp member 22 to the panel 12 to secure the ramp member 22 to the panel 12 along its length.

Figure 7:
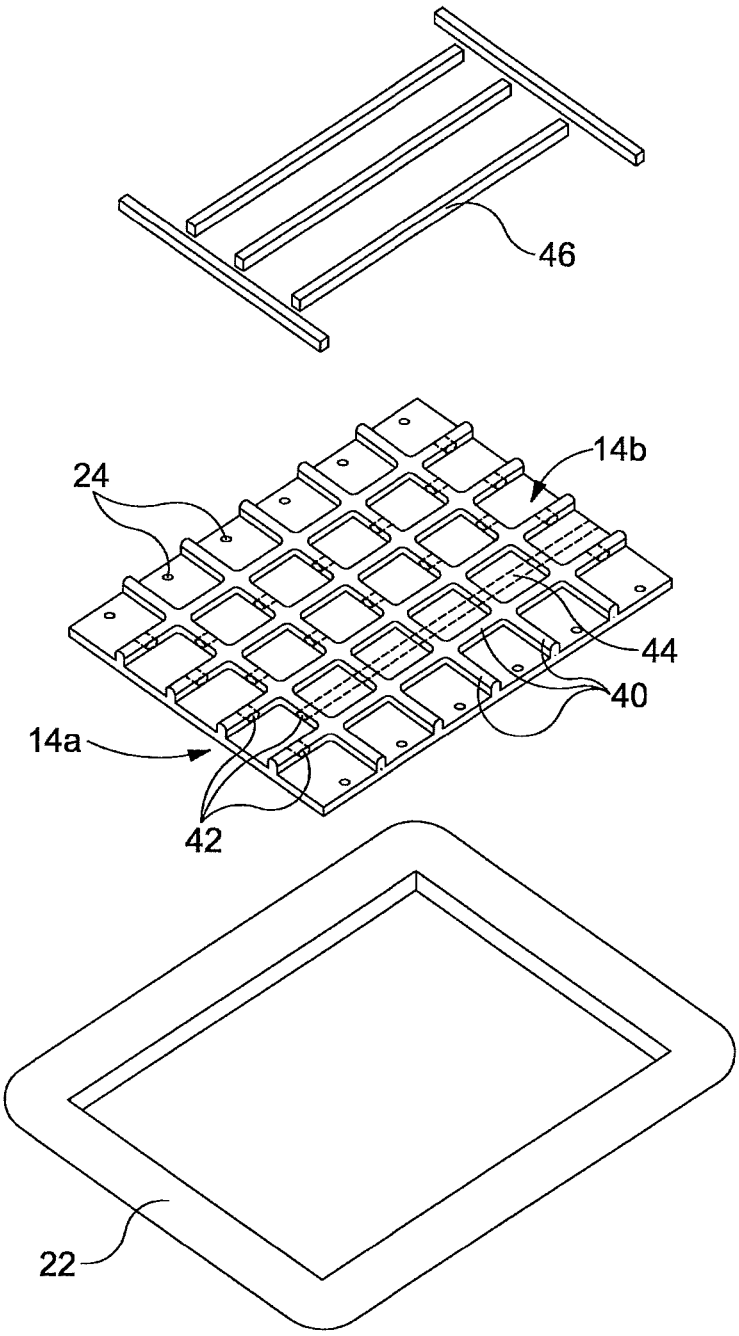
FIG. 7 is an exploded view illustrating a panel similar to that of FIG. 1 showing the parts of the panel in an inverted condition.

As shown in FIG. 7, the underside of the panel 12 may be formed with a series of reinforcing ribs 40, the ribs 40 being integrally moulded with the remainder of the panel 12. In the arrangement illustrated, the ribs 40 extend in two perpendicular directions. The ribs 40 do not themselves contain any additional reinforcement, but rather are simply moulded from the same plastics material as the remainder of the panel 12.

Certain of the ribs 40 are formed with openings 42, the openings 42 of adjacent ones of the ribs 40 being aligned with one another to define a channel or pocket 44. The dimensions of the channel or pocket 44 are such as to permit an elongate reinforcing member 46 to be received therein. During assembly, the reinforcing member 46 is conveniently slid, axially, into the channel or pocket 44, and the shape of the channel or pocket 44 is conveniently such as to retain the reinforcing member 46 in position. However, arrangements are also possible in which the reinforcing member 46 is introduced in a different direction and/or is retained in position using an alternative technique such as by being bolted in position or by using an appropriate adhesive.

The elongate reinforcing member 46 conveniently takes the form of a length of a hollow plastics material tube, conveniently of square or rectangular cross-section, and conveniently manufactured using an extrusion or pultrusion process. Whilst the use of a hollow plastics material elongate reinforcing member is preferred, it will be appreciated that where the invention is used in application in which weight is not a concern then it may be preferred to use a reinforcing member of solid form. Furthermore, the reinforcing member may be of other materials. By way of example, it could be of steel form or the like.

Whilst in the description hereinbefore reference has been made to a single elongate reinforcing member, in practise, a number of such members may be provided in respective channels or pockets formed in the main body. As shown in FIG. 7, where several such reinforcing members are provided, the arrangement may be such that certain of the elongate reinforcing members extend perpendicularly to others thereof.

It will be appreciated that the arrangement described hereinbefore is advantageous in that a load supporting panel is provided of good load supporting strength, the panel being reinforced by the presence of the reinforcing members located within the pockets or channels. Whilst of good strength, it may be of relatively low weight and low cost by using a suitable plastics material in the provision of the reinforcing members. The provision of a lip of ramped form reduces the formation of trip hazards, and the use of materials which result in the lip being of flexible form enhances the stability of the panel, in use, reducing slipping or sliding movement of the panel and reducing noise which could be generated were a panel to be unstably positioned over a trench.

Figure 8:
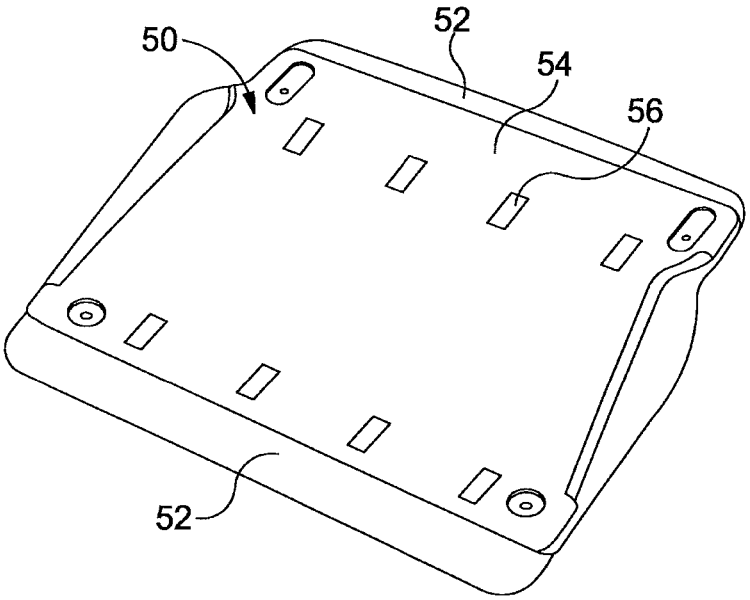
FIG. 8 is a view illustrating a load supporting panel in accordance with another embodiment of the invention.

Whilst the description hereinbefore relates to the application of the invention to a cover intended to cover a trench or cavity formed in a footpath, and which could be modified, if desired, to cover trenches formed in road surfaces, FIG. 8 illustrates another application of the invention. In the arrangement shown in FIG. 8, the load supporting panel 50 takes the form of a ramp intended to aid the passage of pedestrians over a kerb between a raised footpath surface and a lower road surface. The panel 50 is manufactured in substantially the same manner as described hereinbefore. However, as two opposing edges of the panel 50 are not intended to bear against the ground surface, in use, the lip 52 is formed adjacent only the two opposing parts of the periphery of the main body 54 thereof that will bear, in use, against the ground surface. Reinforcement of the main body 54 may be achieved by the formation of channels or pockets within which elongate reinforcing members 56 (visible, in this case, through openings formed in the main body 54) are located in the manner described hereinbefore.

Whilst in the description hereinbefore the main body is of, for example, injection moulded, blow moulded or compression moulded form, with reinforcing ribs formed integrally therewith which define the channel or pocket used to accommodate the reinforcing member, arrangements are possible in which the channel or pocket is otherwise defined. By way of example, no reinforcing ribs may be provided, and instead the main body may be formed with locating features that together define the channel or pocket accommodating the reinforcing member. Furthermore, the main body could be formed of two or more parts which inter-engage to define the channel or pocket.

A wide range of modifications and alterations to the arrangements described hereinbefore may be made without departing from the scope of the invention as defined by the appended claims.

The invention claimed is:

1. A cover comprising a load bearing panel of generally square or rectangular form and having an upper surface and an underside surface, at least some of the edges of load bearing panel being provided with ramp members which are secured along their length to the load bearing panel, the ramp members each defining an upper ramped surface and a lower, ground engaging surface, wherein the ground engaging surface is spaced beneath the underside surface of the load bearing panel, and wherein the load bearing panel comprises at least one of a projecting flange or recess, the at least one projecting flange or recess provided with interlocking features comprising one or more openings through which material of the ramp members may pass or extend during an overmoulding thereof, thereby allowing material of the ramp members to extend through the one or more openings to secure the ramp members along their length to the load bearing panel.

2. A cover according to claim 1, wherein the ramp members are of a flexible plastics material.

3. A cover according to claim 1, wherein the cover includes ramp members adjacent all four edges thereof, the ramp members being formed in a single moulding operation, the ramp members being formed integrally with one another as a single element.

4. A cover according to claim 1, wherein the upper surface of the load bearing panel is provided with an anti-slip surface texture or the like.

5. A cover according to claim 1, wherein the load bearing panel is of a brightly coloured material so as to make it clearly visible.

6. A cover according to claim 1, wherein the panel is formed with one or more vent openings.

7. A cover according to claim 1, wherein the panel is formed with a gas probe port.

8. A cover according to claim 1, wherein the ramp members are overmoulded onto the edges of the load bearing panel.

9. A cover according to claim 8, wherein the material of the ramp members that is allowed to pass or extend through the one or more openings form columns during the overmoulding thereof.

10. A cover according to claim 8, wherein the interlocking features comprise columns formed by the load bearing panel and arranged to provide the one or more openings through which the material of the ramp members extends to secure the ramp member to the load bearing panel.

11. A method of manufacture of a cover, the method comprising the steps of moulding a load bearing panel of generally square or rectangular form and having an upper surface and an underside surface, the panel comprising a projecting flange or recess, providing the projecting flange or recess with interlocking features comprising openings through or into which material of ramp members may pass or extend during an overmoulding thereof, allowing material of the ramp members to extend through the openings to secure the ramp members along their length to the load bearing panel, and overmoulding the ramp members onto at least some of the edges of the load bearing panel, the ramp members each defining an upper ramped surface and a lower, ground engaging surface, wherein the ground engaging surface is spaced beneath the underside surface of the load bearing panel.

* * * * *